US005590670A

United States Patent [19]

Allred

[11] Patent Number: 5,590,670

[45] Date of Patent: Jan. 7, 1997

[54] BRAID TIP

[76] Inventor: Donald E. Allred, Box 619, El Prado, N.M. 87529

[21] Appl. No.: 432,097

[22] Filed: May 1, 1995

[51] Int. Cl.[6] ..... A45D 8/04; A45D 8/34; A45D 8/36

[52] U.S. Cl. ..... 132/273; 132/276; 132/277; 132/275

[58] Field of Search ..... 132/273, 274, 132/275, 276, 277, 278, 283, 212; D28/39, 40, 41, 42, 43

[56] References Cited

U.S. PATENT DOCUMENTS

| | | | |
|---|---|---|---|
| 127,918 | 6/1872 | Parson et al. | 54/78 |
| 148,367 | 3/1874 | Howard | 54/78 |
| 602,699 | 4/1898 | Davis . | |
| 651,764 | 6/1900 | Mullinix . | |
| 717,499 | 12/1902 | Gouy . | |
| 1,731,994 | 10/1929 | Zeppenfeld . | |
| 1,767,681 | 6/1930 | Kapustka . | |
| 2,486,122 | 10/1949 | Corubia | 132/273 |
| 5,086,612 | 2/1992 | Anderson | 54/78 |

*Primary Examiner*—Gene Mancene
*Assistant Examiner*—Pedro Philogene
*Attorney, Agent, or Firm*—Robert W. Harris

[57] ABSTRACT

A device for covering the end of a hair braid, having a hollow sleeve, open at its upper end and closed at its lower end, and having a W-shaped insert, which may be used to secure the end of the hair braid by wrapping the braid end around the lower middle portion of the W, and having rounded projections at the upper sides of the W, which spring into longitudinally oriented retaining slots in the upper sides of the sleeve, when the insert is inserted sufficiently into the sleeve. The insert is slightly oversized in comparison to the interior width of the sleeve, and is made of a material having sufficient elasticity to be insertable within the sleeve, and to cause the projections to snap into the retaining slots of the sleeve, when the insert is sufficiently inserted.

9 Claims, 1 Drawing Sheet

BRAID TIP

BACKGROUND OF THE INVENTION

The invention concerns devices for securing and/or adorning the end of a human hair braid, and more particularly to a device for covering the end of the braid.

Although a hair braid may be quite attractive, the end of the braid is comparatively unsightly, due to the uneven appearance of the ends of the hairs of the braid. Thus there is a need for a device which may be attached to the end of a hair braid, which will cover the end, and which device may itself be adorned with an ornamental design, and fashioned of an attractive material, such as silver, for example, though the present invention is not limited to the use of any particular material for its fabrication. There is also a need for such a device which may be quickly and easily attached to, and removed from, the hair braid.

Although the documents attached to applicant's information disclosure statement disclose various devices which may be used to secure the end of a hair braid, e.g. against unravelling of the hair, applicant is not aware of a device employing the simple approach of the present invention, in which a hollow sleeve receives a hair end securing means, and having a locking and release means for locking the hair end securing means within the housing, and for releasing same from the housing when it is desired to remove the braid tip device from the end of the hair braid.

SUMMARY OF THE INVENTION

The invention is a device for covering the end of a human hair braid. The device has a hollow sleeve, which receives a hair end securing means, into the sleeve, and has a locking and release means, for holding the hair end securing means within the sleeve and for releasing the hair end securing means from the sleeve when it is desired to remove the hair end securing means from the sleeve. In the preferred embodiment, the sleeve is closed at its lower end and open at its upper end. The sleeve receives a W-shaped insert, which is the hair end securing means of the preferred embodiment, and which insert has rounded upper ends which fit two retaining slots on the upper sides of the sleeve, when the insert is pushed into the sleeve. The insert is slightly oversized in width, with respect to the interior width of the sleeve, so that the rounded upper edges of the insert press against the inner walls of the sleeve as the insert is pushed into the sleeve, so that the insert will lock in place when its rounded upper ends reach the retaining slots. The user desiring to cover a hair braid tip simply wraps the end of the hair at least twice around the middle lower portion of the insert, and then pushes the insert into the sleeve until the upper rounded ends of the sleeve lock into the retaining slots of the sleeve. To remove the device from the hair braid, the user simply presses inward laterally on the rounded upper ends of the insert, which may be pressed through the retaining slots in the sleeve, and simultaneously pulls upward on the hair braid and/or downward on the sleeve, to free the insert from the retaining slots, and thus allow the insert to be removed from the sleeve, so that the braid tip may be unwrapped from the insert. Thus in the preferred embodiment, the locking and release means comprises the combination of the oversized W-shaped insert, its rounded upper ends, and the retaining slots in the sleeve.

BRIEF DESCRIPTION OF THE DRAWINGS

Each of the drawings illustrates the same preferred embodiment of the invention, as follows.

DESCRIPTION OF THE PREFERRED EMBODIMENT

Figure 1:
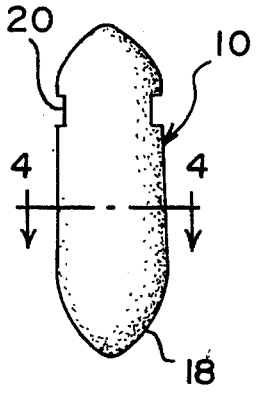
FIG. 1 is a front elevational view of the sleeve.
Figure 2:
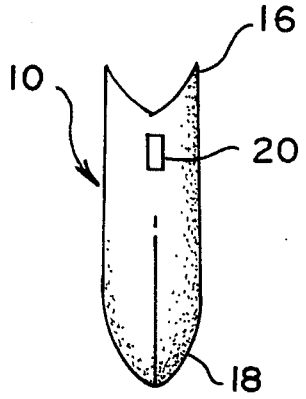
FIG. 2 is a side elevational view of the sleeve.
Figure 3:
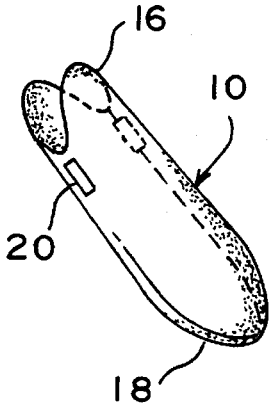
FIG. 3 is a perspective view of the sleeve.

Referring now to the drawings, in which like reference numbers denote like or corresponding elements, the principal components of the preferred embodiment form of the present invention, are a sleeve 10, and an insert 12. The insert 12 is used to secure the end of a human hair braid 14, for insertion into sleeve 10, to obscure the end of hair braid 14 from view.

The sleeve 10 is hollow and is open at its upper end 16, for receiving a hair braid 14, and has an inside diameter at least slightly exceeding the diameter of hair braid 14. The sleeve 10 is closed at its lower ends, in the preferred embodiment. The sleeve 10 may be fabricated from two arcuate pieces of metal, soldered or welded together, or may be cast as a single piece of metal, or made of plastic by the mold injection process. The sleeve 10 has two retaining slots 20, one on either side thereof, opposite one another, near the upper end 16 of sleeve 10, said retaining slots 20 being oriented longitudinally, i.e. parallel to the principal longitudinal axis of the sleeve 10.

Figure 5:
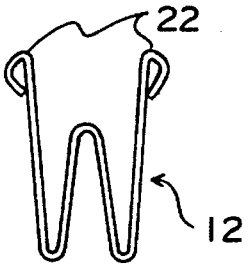
FIG. 5 is a front elevational view of the insert.
Figure 6:
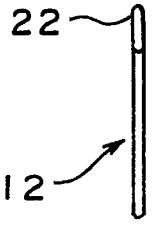
FIG. 6 is a side elevational view of the insert.
Figure 7:
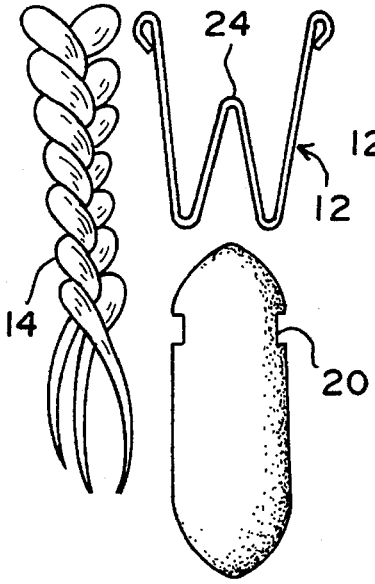
FIG. 7 is a front elevational view separately showing the hair braid, the insert and the sleeve, prior to use of the invention.
Figure 8:
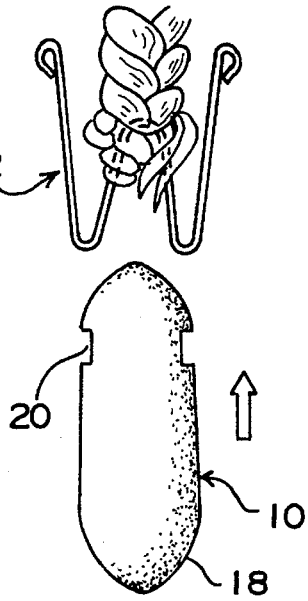
FIG. 8 is a front elevational view as in FIG. 6, except showing the hair ends wrapped around the middle portion of the insert, above the sleeve, as would be the configuration just prior to insertion of the insert within the sleeve.
Figure 9:
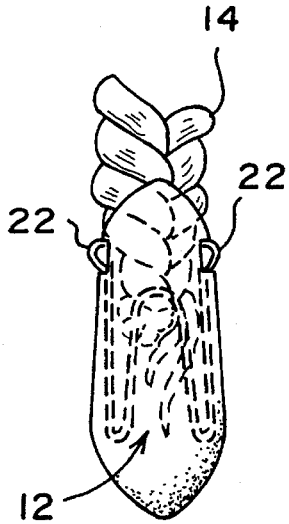
FIG. 9 is a front elevational view showing the insert with hair braid end, inserted within the sleeve.

The insert 12 is a W-shaped piece of material having some degree of elasticity, fabricated of metal in the preferred embodiment, having rounded lateral projections 22 at its upper end, as shown in FIG. 5. The width across insert 12 at its top, including the width of projections 22, slightly exceeds the interior width of sleeve 10. Thus when insert 12 is inserted into sleeve 10, the projections 22 of insert 12 press against the inner walls of sleeve 10. The elasticity of insert 12, and the amount by which the width of insert 12 exceeds the interior width of sleeve 10, are chosen such that it is not difficult to compress insert 12 laterally by a sufficient amount, such that insert 12 may be inserted within sleeve 10.

The retaining slots 20 on the sides near the upper end 16 of sleeve 10, are of a size just sufficient to receive the projections 22 of insert 12, when insert 12 is inserted within sleeve 10 sufficiently that the projections 22 reach the retaining slots 20. Thus when insert 12 is inserted that far within sleeve 10, the elasticity of insert 12 causes the projections 22 of insert 12 to spring into the retaining slots 20, so that insert 12 is secured and held within sleeve 10. However, by pressing laterally inward upon the projections 22, through retaining slots 20, and then pulling upward on insert 12, and/or downward on sleeve 10, it is readily possible to quickly disengage insert 12 and sleeve 10.

The operation of the invention is straightforward. The user first wraps the end of hair braid 14 at least twice around the middle, hair securing portion 24 of insert 12. Then the user inserts the insert 12 down into sleeve 10 at the upper end 16 of sleeve 10, first pushing laterally inward on projections 22 of insert 12 sufficiently to get the entire body of insert 12 inserted into sleeve 10, and then continues to push insert 12 downward within sleeve 10, pushing with the hair braid 14 itself, until the projections 22 reach, and snap into the ,retaining slots 20 of sleeve 10. To remove the device from the hair braid 14, the user simply grasps the sleeve 10 in one hand and pushes inward laterally on the projections 22, with two fingers of that same hand, through the retaining slots 20, while simultaneously pulling upward on the hair braid 14 with the other hand.

Those familiar with the art will appreciate that the invention may be employed in configurations other than the specific forms disclosed herein, without departing from the essential substance thereof.

For example, and not by way of limitation, although the sleeve 10 is closed at its lower end 18 in the preferred embodiment, this is not necessary. If the sleeve 10 has sufficient length to cover the end of the hair braid 14, it would be possible to use a sleeve 10 having an open lower end 18, and still accomplish the purposes of the invention.

Figure 4:
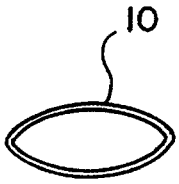
FIG. 4 is a sectional view of the sleeve, on the section indicated by the section line 4—4 in FIG. 1.

Similarly, it is not necessary that the sleeve 10 have the cross sectional form of the preferred embodiment, illustrated in FIG. 4. One may employ a sleeve 10 which is rectangular in cross section, circular in cross section, elliptical in cross section, or has any other convenient form of cross section.

Although the preferred embodiment employs a hair end securing means in the form of the W-shaped insert 12, with the end of the hair braid 14 being wrapped around the middle portion of insert 12, the invention is not limited to this particular form of hair end securing means. For example, an insert having a spring-driven clamp might instead be used, with the end of the hair braid 14 being secured to the insert by the clamp.

Although the preferred embodiment would be fabricated using metal, namely sterling silver for the sleeve 10 and spring steel for the insert 12, it is to be understood that the invention is not limited to the use of any particular material. Other materials of suitable strength and elasticity (for the insert 12) may be used instead. Suitable plastics might be used, for example. For reasons of differing personal tastes and ornamentality considerations, it may be desirable to have the sleeve 10 made of any of a variety of materials, including, for example, silver, wood, ceramic, leather, bone, or horn.

Similarly, although the retaining slots 20 of the preferred embodiment are rectangular in form, with their longer sides oriented parallel to the longitudinal axis of the sleeve 10, it is of course not necessary to use retaining slots of this form. For example, circular retaining slots could be used instead.

Although any desired ornamental designs may be inscribed or otherwise placed on the exterior of the sleeve 10, any such designs are not limitations on the invention claimed herein. That is to say, each of the claims set forth below is intended to encompass any other device having, either literally or under the doctrine of equivalents, the elements therein recited or incorporated by reference from another claim, regardless of whether said other device also has any ornamental design on the exterior of sleeve 10, or has any other additional elements.

The scope of the invention is defined by the following claims, including also all subject matter encompassed by the doctrine of equivalents as applicable to the claims.

I claim:

1. Hair braid tip device, for covering the end of a human hair braid, comprising:

(a) a hollow sleeve, having an inside diameter at least slightly exceeding the diameter of said human hair braid, and having an open upper end for receiving said end of said human hair braid, and having a principal longitudinal axis;

(b) a securing means, for securing said end of said human hair braid for insertion into said sleeve;

(c) a locking and release means, for holding said securing means within said sleeve, and for releasing said securing means when it is desired to remove said securing means from said sleeve;

and wherein said securing means is a W-shaped insert, and wherein said insert has rounded projections on both upper sides of said insert, and wherein the width of said insert slightly exceeds the inside diameter of said sleeve and wherein said insert is made of a material having elasticity sufficient to allow said insert to be compressed sufficiently to be inserted within said sleeve, and wherein said sleeve has two retaining slots on opposite sides of said sleeve, near said upper end of said sleeve, said retaining slots being of a size sufficient to receive said rounded projections of said insert and wherein said locking and release means comprises the combination of said oversized width of said insert in relation to said inside diameter of said sleeve, said rounded projections on said upper sides of said insert and said retaining slots of said sleeve.

2. The hair braid tip device of claim 1, wherein said retaining slots are rectangular in form and each have length greater than their width and wherein said length is oriented at least substantially parallel to said principal longitudinal axis of said sleeve.

3. The hair braid tip device of claim 1, wherein said retaining slots are circular.

4. Hair braid tip device, for covering the end of a human hair braid, comprising:

(a) a hollow sleeve, closed at its lower end, having an inside diameter at least slightly exceeding the diameter of said human hair braid, and having an open upper end for receiving said end of said human hair braid, and having a principal longitudinal axis;

(b) a securing means, for securing said end of said human hair braid for insertion into said sleeve; and (c) a locking and release means, for holding said securing means within said sleeve, and for releasing said securing means when it is desired to remove said securing means from said sleeve.

5. Hair braid tip device, for covering the end of a human hair braid comprising:

(a) a hollow sleeve, having an inside diameter at least slightly exceeding the diameter of said human hair braid, and having an open upper end for receiving said end of said human hair braid, and having a principal longitudinal axis;

(b) a securing means, for securing said end of said human hair braid for insertion into said sleeve; and (c) a locking and release means, for holding said securing means within said sleeve, and for releasing said securing means when it is desired to remove said securing means from said sleeve;

wherein said device is made entirely of metal.

6. Hair braid tip device, for covering the end of a human hair braid, comprising:

(a) a hollow sleeve, having an inside diameter at least slightly exceeding the diameter of said human hair braid, and having an open upper end for receiving said end of said human hair braid, and having a principal longitudinal axis;

(b) a securing means, for securing said end of said human hair braid for insertion into said sleeve; and (c) a locking and release means, for holding said securing means within said sleeve, and for releasing said securing means when it is desired to remove said securing means from said sleeve;

wherein said device is made entirely of plastic.

7. Hair braid tip device, for covering the end of a human hair braid, comprising:

(a) a hollow sleeve, made of metal, having an inside diameter at least slightly exceeding the diameter of said human hair braid, and having an open upper end for receiving said end of said human hair braid, and having a principal longitudinal axis;

(b) a securing means, made of plastic, for securing said end of said human hair braid for insertion into said sleeve; and (c) a locking and release means, for holding said securing means within said sleeve, and for releasing said securing means when it is desired to remove said securing means from said sleeve.

8. Hair braid tip device, for covering the end of a human hair braid, comprising:

(a) a hollow sleeve made of plastic, having an inside diameter at least slightly exceeding the diameter of said human hair braid, and having an open upper end for receiving said end of said human hair braids and having a principal longitudinal axis;

(b) a securing means, made of metal, for securing said end of said human hair braid for insertion into said sleeve; and (c) a locking and release means, for holding said securing means within said sleeve, and for releasing said securing means when it is desired to remove said securing means from said sleeve.

9. Hair braid tied device, for covering the, end of a human hair braid, comprising:

(a) a hollow sleeve, having an inside diameter at least slightly exceeding the diameter of said human hair braid, and having an open upper end for receiving said end of said human hair braid, and having a principal longitudinal axis;

(b) a securing means, for securing said end of said human hair braid for insertion into said sleeve, wherein said securing means includes a clip; and (c) a locking and release means, for holding said securing means within said sleeve, and for releasing said securing means when it is desired to remove said securing means from said sleeve.

* * * * *